US006799942B1

(12) United States Patent
Tzeng et al.

(10) Patent No.: US 6,799,942 B1
(45) Date of Patent: Oct. 5, 2004

(54) COMPOSITE FAN

(75) Inventors: Yih-Wei Tzeng, Taipei (TW); Win-Haw Chen, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 10/667,370

(22) Filed: Sep. 23, 2003

(51) Int. Cl.[7] ..... F04D 29/54

(52) U.S. Cl. ..... 415/61; 415/68; 415/193; 415/209.1; 415/211.2

(58) Field of Search ..... 415/61, 66, 68, 415/69, 193, 194, 194.4, 199.5, 209.1, 211.2

(56) References Cited

U.S. PATENT DOCUMENTS 2,313,413 A * 3/1943 Weske ..... 415/193

6,663,342 B2 * 12/2003 Huang et al. ..... 415/199.5

FOREIGN PATENT DOCUMENTS

GB 622415 A * 5/1949 ..... 415/199.4

* cited by examiner

*Primary Examiner*—Christopher Verdier
(74) *Attorney, Agent, or Firm*—Birch, Stewart, Kolasch & Birch, LLP

(57) ABSTRACT

A composite fan consists of a first fan and a second fan located on the air outlet side of the first fan. The first fan has a plurality of first rotary vanes and a plurality of first guide vanes located on the air outlet side of the first rotary vanes. The second fan has a plurality of second rotary vanes and a plurality of second guide vanes located on the air inlet side of the second rotary vanes. Each of the second guide vanes corresponds to and is coupled with each of the first guide vanes to form a continuous curved surface.

7 Claims, 5 Drawing Sheets

COMPOSITE FAN

FIELD OF THE INVENTION

The invention relates to a fan, and particularly to a composite fan that has guide vanes to substitute for brackets of driving devices.

BACKGROUND OF THE INVENTION

Refer to FIG. 1 for a conventional radiation air fan that includes a frame 31 housing a plurality of rotary vanes 32. The rotary vanes 32 are coupled radially on a hub 33 which is mounted on a driving device 34. The driving device 34 is fixedly located in the frame 31 through a bracket 35. When the driving device 34 rotates, it drives the hub 33 and the rotary vanes 32 to rotate and generate airflow. On the air outlet side of the rotary vanes 32, there is a plurality of guide vanes 36 to channel the airflow generated by the rotary vanes 32 to boost airflow volume and air pressure.

In the conventional structure set forth above, the bracket 35 merely serves to support the driving device 34. It takes a lot of space and increases the size of the radiation fan. Moreover, the bracket 35 disrupts the airflow generated by the rotary vanes 32. As a result, heat dissipation performance of the air fan suffers.

Refer to FIG. 2 for a conventional composite fan. It has two sets of rotary vanes 41 and 42 to match one set of guide vanes 43. Airflow generated by the first set of rotary vanes 41 is channeled by the guide vanes 43, and the other set of rotary vanes 42 rotates in the reverse direction to boost the airflow and heat dissipation efficiency of the air fan.

However, the composite structure mentioned above multiplies the disadvantages of the conventional air fans. In addition, with two sets of rotary vanes 41 and 42 driven respectively by separated driving devices 44 and 45; two brackets 46 and 47 are needed to support the driving devices 44 and 45. The size of the air fan increases significantly. This is against the prevailing trend that demands slim and light electronic devices.

SUMMARY OF THE INVENTION

In view of the aforesaid disadvantages, the primary object of the invention is to provide a composite fan that includes first guide vanes on the air outlet side of the first rotary vanes and second guide vanes on the air inlet side of the second rotary vanes to correspond to and couple with each other to form continuous curved surfaces. The first guide vanes and the second guide vanes are connected respectively in a radial manner to a first support section and a second support section that hold the driving devices to drive the first rotary vanes and the second rotary vanes.

In order to achieve the foregoing object, the composite fan of the invention consists of a first fan and a second fan. The first fan has a plurality of first rotary vanes and a plurality of first guide vanes located on the air outlet side of the first rotary vanes. The first guide vanes are coupled radially to a first support section that houses a first driving device. The first driving device drives the first rotary vanes to rotate and generate airflow.

The second fan has a plurality of second rotary vanes and a plurality of second guide vanes located on the air inlet side of the second rotary vanes. The second guide vanes are coupled radially to a second support section that houses a second driving device. The second driving device drives the second rotary vanes to rotate and generate airflow. The first rotary vanes and the second rotary vanes rotate in opposite directions to generate greater heat dissipation.

The main technical feature of the invention is that the second guide vanes corresponded to the first guide vanes in such a manner that each of the first guide vanes and each of the second guide vanes may be coupled to form a continuous curved surface. Thus when the first driving device drives the first rotary vanes to rotate and generate airflow, the airflow is channeled through the first and the second guide vanes to form increased airflow volume and air pressure. The boosted airflow is transferred to the second rotary vanes driven by the second driving device to form an even stronger airflow to be output.

The continuous curved surface formed by coupling the first guide vanes and the second guide vanes requires a matching design on the shape and structure of the first rotary vanes at the upstream location to increase output air pressure.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
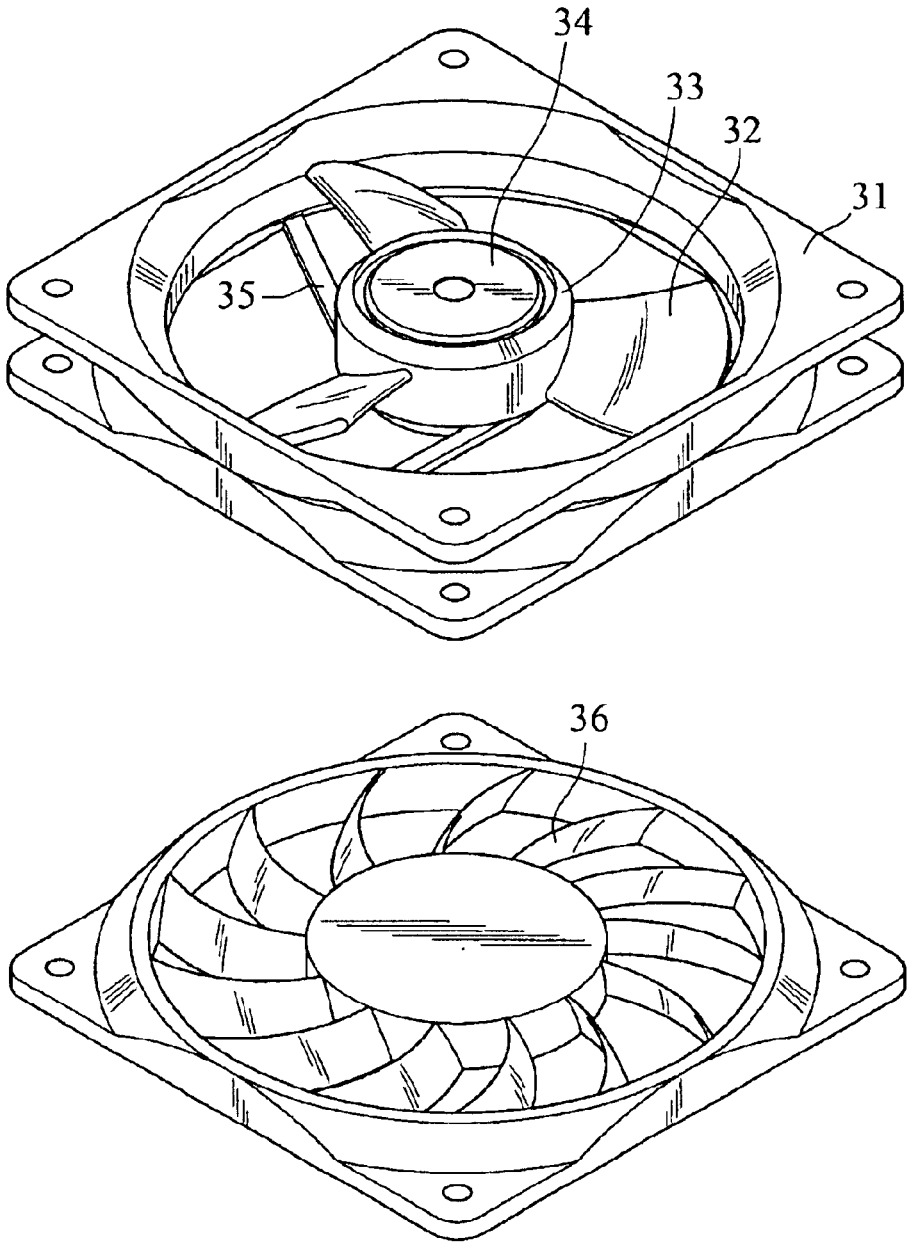
FIG. 1 (PRIOR ART)
FIG. 1 is a perspective view of a conventional radiation air fan.
Figure 2:
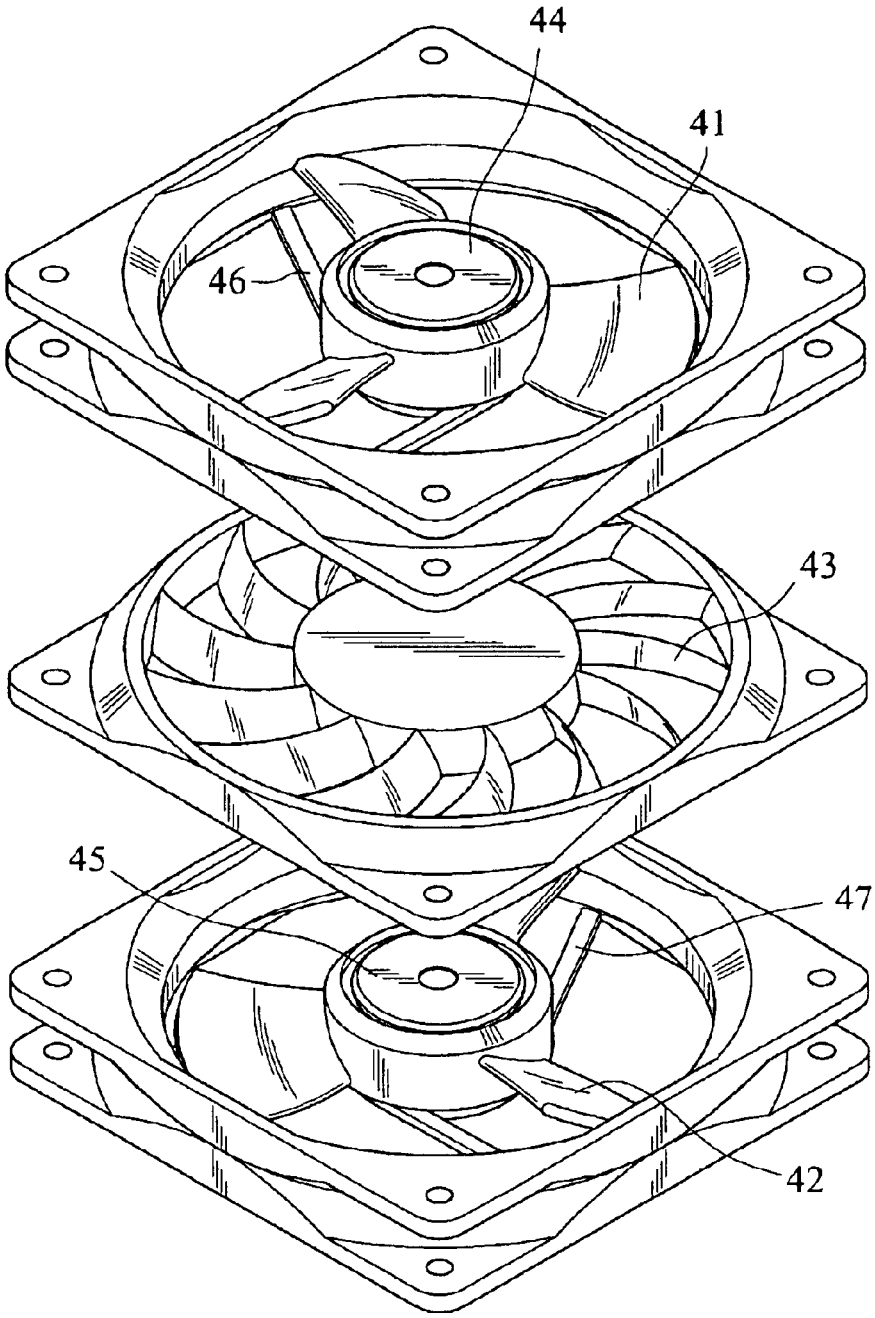
FIG. 2 (PRIOR ART)
FIG. 2 is a perspective view of a conventional composite fan.
Figure 3:
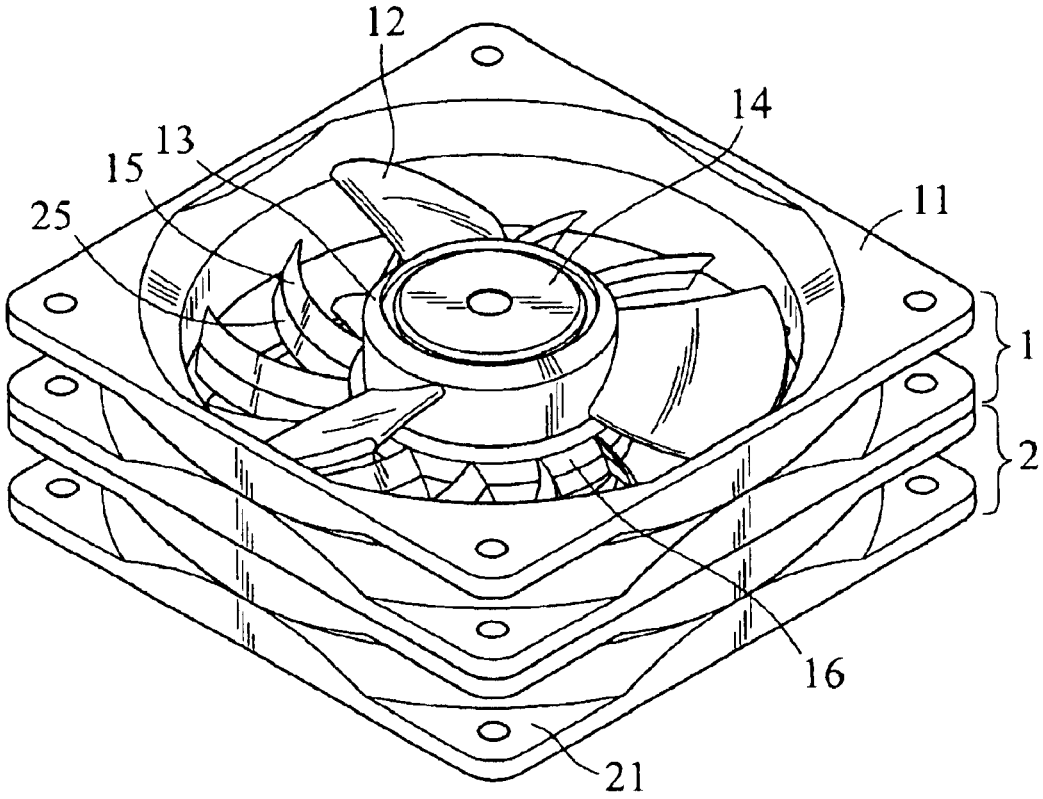
FIG. 3 is a perspective view of the composite fan of the invention.
Figure 4:
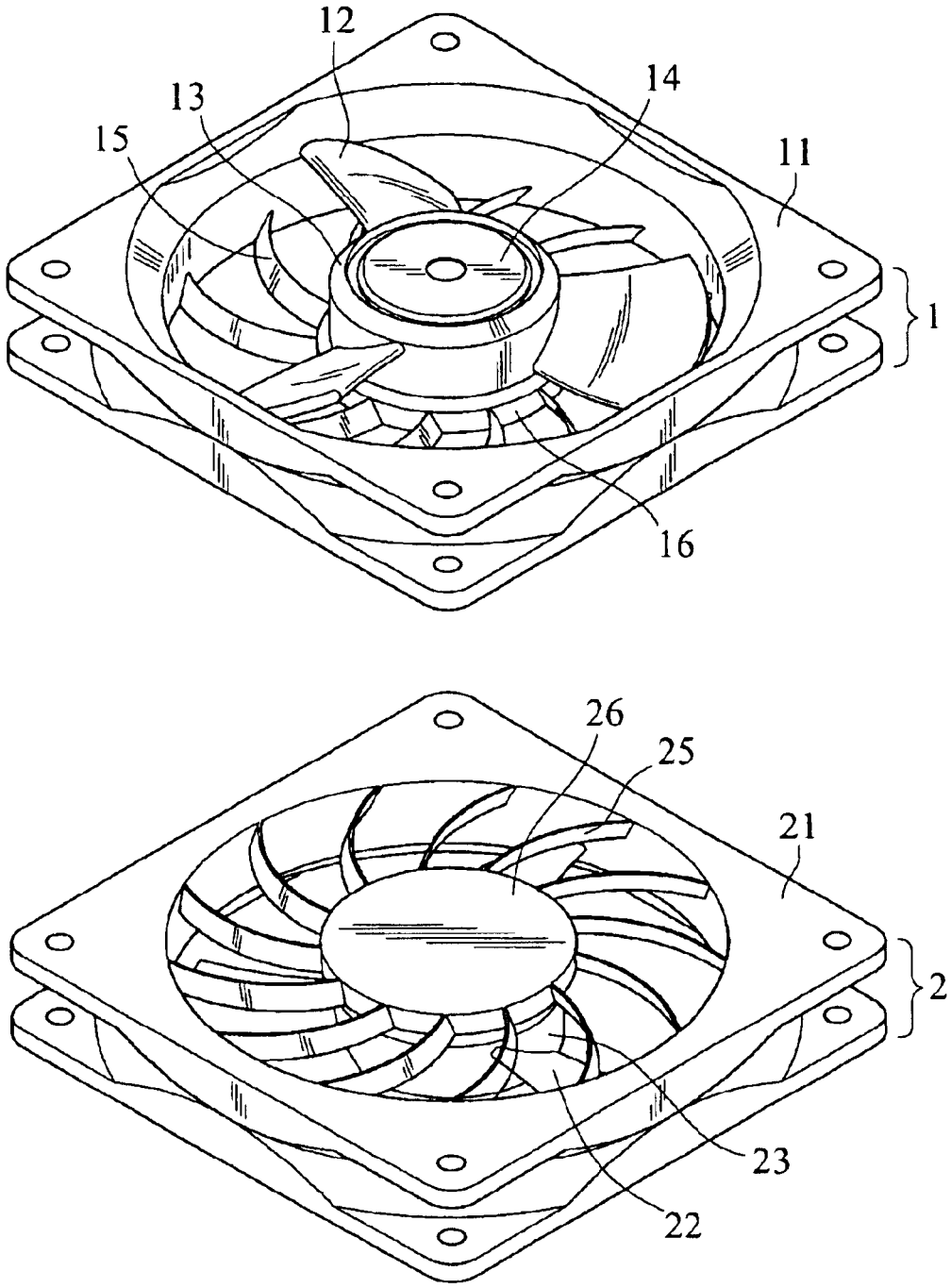
FIG. 4 is an exploded view of the composite fan of the invention.
Figure 5:
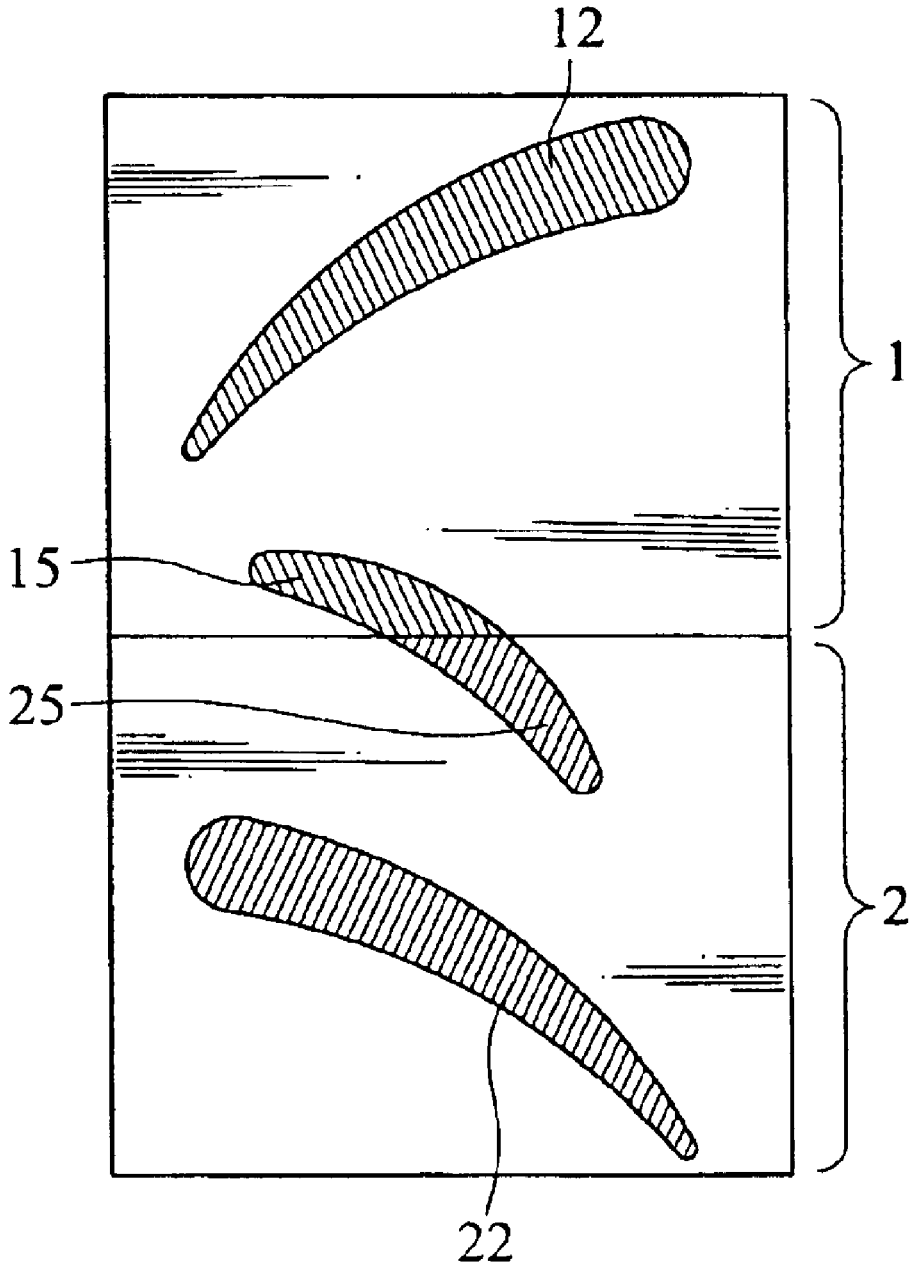
FIG. 5 is a schematic sectional view of the invention showing the relationship of the vanes.

Referring to FIGS. 3, 4 and 5, the composite fan of the invention consists of a first fan 1 and a second fan 2. The first fan 1 is located at the upstream location of the composite fan while the second fan 2 is located at the downstream location of the composite fan.

The first fan 1 has a first frame 11 that houses a plurality of first rotary vanes 12. The first rotary vanes 12 are radially coupled on a first hub 13, which in turn is coupled on a first driving device 14. The first driving device 14 drives the first hub 13 to rotate. As a result, the first rotary vanes 12 coupled on the first hub 13 also are rotated to generate airflow output.

The first frame 11 further has a plurality of first guide vanes 15 located on the air outlet side of the first rotary vanes 12. The first guide vanes 15 are connected to a first support section 16 in a radial manner. The first support section 16 houses the first driving device 14 to drive the first hub 13 and the first rotary vanes 12 to rotate in the first frame 11 to generate airflow.

The second fan 2 has a second frame 21 that houses a plurality of second rotary vanes 22. The second rotary vanes 22 are radially coupled on a second hub 23, which in turn is coupled on a second driving device. The second driving device drives the second hub 23 to rotate. As a result, the second rotary vanes 22 coupled on the second hub 23 also are rotated to generate airflow output.

The second frame 21 further has a plurality of second guide vanes 25 located on the air inlet side of the second rotary vanes 22. Each of the second guide vanes 25 corresponds to each of the first guide vanes 15. Each of the first guide vanes 15 is coupled to each of the second guide vanes 25 to form a continuous curved surface. The second guide vanes 25 are connected to a second support section 26 in a radial manner. The second support section 26 houses the second driving device to drive the second hub 23 and the second rotary vanes 22 to rotate in the second frame 21 to generate airflow.

When the first fan 1 and the second fan 2 are coupled, the first frame 11 and the second frame 21 are coupled to form an integrated member. Each of the first guide vanes 15 in the first frame 11 corresponds to and is coupled with each of the second guide vanes 25 to form a continuous curved surface. When the first driving device 14 drives the first rotary device 12 to rotate and generate airflow, the generated airflow is channeled through the first guide vanes 15 and the second guide vanes 25 to increase airflow volume and air pressure. The boosted airflow further is transferred to the second rotary vanes 22, which rotate in the opposite direction of the first rotary vanes 12 to generate greater heat dissipation.

Because the first guide vanes 15 and the second guide vanes 25 are coupled to form a continuous curved surface, and the first rotary vanes 12 at the upstream are formed in desired shapes and structure, output air pressure may increase.

By coupling the first guide vanes 15 with the second guide vanes 25, the composite fan of the invention can not only substitute for the conventional support brackets for housing the driving devices to save space, airflow generated by the first rotary vanes 12 can also be channeled as desired to the second rotary vanes 22 to increase heat dissipation performance.

Moreover, in the event that either the first fan 1 or the second fan 2 malfunctions, the broken fan may be removed for repair while the unbroken fan may continue to operate. Compared with the conventional composite fan for which the whole set of fans must be replaced, the invention offers greater convenience and also reduces maintenance cost.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A composite fan, comprising:

a first fan which has a plurality of first rotary vanes and a plurality of first guide vanes located on an air outlet side of the first rotary vanes; and a second fan located on an air outlet side of the first fan having a plurality of second rotary vanes and a plurality of second guide vanes located on an air inlet side of the second rotary vanes, each of the second guide vanes being corresponded to and coupled with each of the first guide vanes to form a continuous curved surface.

2. The composite fan of claim 1, wherein each of the first guide vanes is connected radially to a first support section.

3. The composite fan of claim 2, wherein the first support section houses a first driving device to drive the first rotary vanes to generate airflow.

4. The composite fan of claim 3, wherein each of the first rotary vanes is connected radially to a first hub which is coupled on the first driving device.

5. The composite fan of claim 1, wherein each of the second guide vanes is connected radially to a second support section.

6. The composite fan of claim 5, wherein the second support section houses a second driving device to drive the second rotary vanes to generate airflow.

7. The composite fan of claim 6, wherein each of the second rotary vanes is connected radially to a second hub which is coupled on the second driving device.

* * * * *